US006939062B2

(12) United States Patent
Ogg et al.

(10) Patent No.: US 6,939,062 B2
(45) Date of Patent: Sep. 6, 2005

(54) SYSTEM AND LAYOUT FOR PROPER PRINTING OF NETSTAMPS AND OTHER LABELS

(75) Inventors: Craig Ogg, Long Beach, CA (US); Patrick Gaane Faustino, Los Angeles, CA (US); Kyle Kevin Huebner, Manhattan Beach, CA (US); Evelyn Jane Ko, Los Angeles, CA (US); Mark Krojansky, Sherman Oaks, CA (US); Damon Michael Cleckler, Pasadena, CA (US)

(73) Assignee: Stamps.Com, Los Angeles, CA (US)

( * ) Notice: Subject to any disclaimer, the term of this patent is extended or adjusted under 35 U.S.C. 154(b) by 0 days.

(21) Appl. No.: 10/429,642

(22) Filed: May 5, 2003

(65) Prior Publication Data

US 2004/0223798 A1 Nov. 11, 2004

(51) Int. Cl.[7] ..... B41J 5/30

(52) U.S. Cl. ..... 400/62; 400/76; 705/401; 705/408

(58) Field of Search ..... 400/61–62, 70, 400/76; 705/60–62, 401–411; 101/47, 66, 71; 283/71, 101–110

(56) References Cited

U.S. PATENT DOCUMENTS 5,848,401 A * 12/1998 Goldberg et al. ..... 705/408
6,010,156 A 1/2000 Block
6,736,067 B2 * 5/2004 Patton ..... 101/483
2002/0040353 A1 * 4/2002 Brown et al. ..... 705/401
2002/0046195 A1 * 4/2002 Martin et al. ..... 705/401
2002/0073039 A1 * 6/2002 Ogg et al. ..... 705/60
2002/0083020 A1 * 6/2002 Leon ..... 705/401
2004/0070194 A1 * 4/2004 Janetzke et al. ..... 283/71

FOREIGN PATENT DOCUMENTS

WO WO 200135347 A2 * 5/2001 ..... G07B/17/04

OTHER PUBLICATIONS www.simplypostage.com/freestamps, "No hardware, no software, no hassles—Simply Postage?," Neopost Online, Inc., Sep. 2000 (2 pages).

* cited by examiner

*Primary Examiner*—Minh Chau
(74) *Attorney, Agent, or Firm*—Christie, Parker & Hale, LLP

(57) ABSTRACT

A system for assisting a user with the proper feeding of sheets of labels into a printer so that the labels may be properly printed with postage indicia. The system providing a sheet bearing pre-printed labels for further printing with postage indicia, the sheet having a target marker located thereon. Further provided is an interactive computer software that guides a user to feed a sheet of labels into the printer, directs the printer to print an indication mark on the sheet of labels, and queries the user as to where an indication mark appears on the sheet of labels. The invention further provides a sheet bearing pre-printed labels for further printing with postage indicia, having an area where a plurality of self-stick labels are located, wherein each label is pre-printed with a serial number, and a perimeter margin area having a target marker located thereon.

7 Claims, 11 Drawing Sheets

FIG. 1
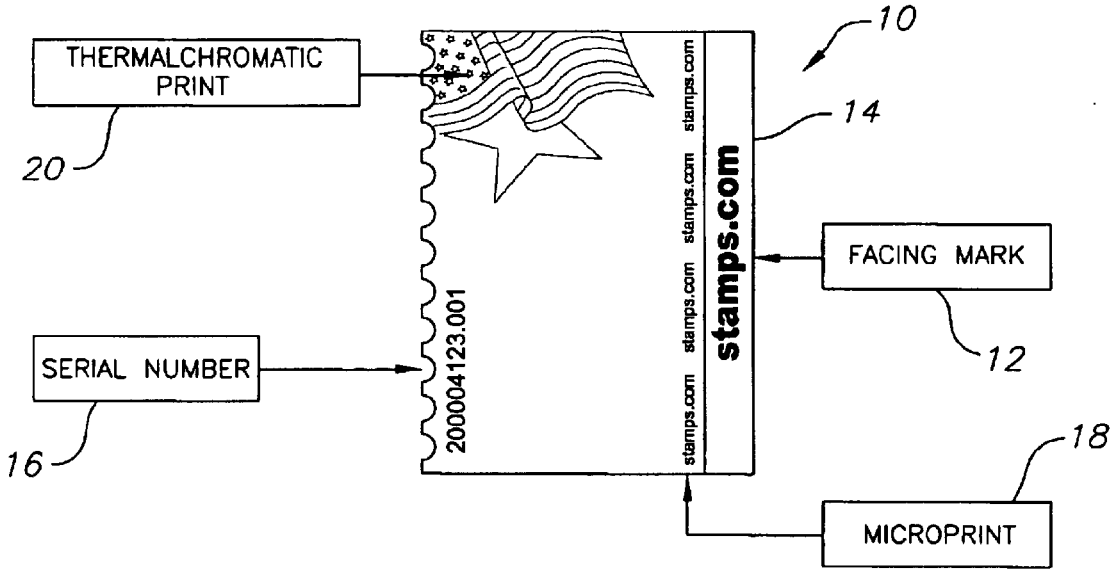
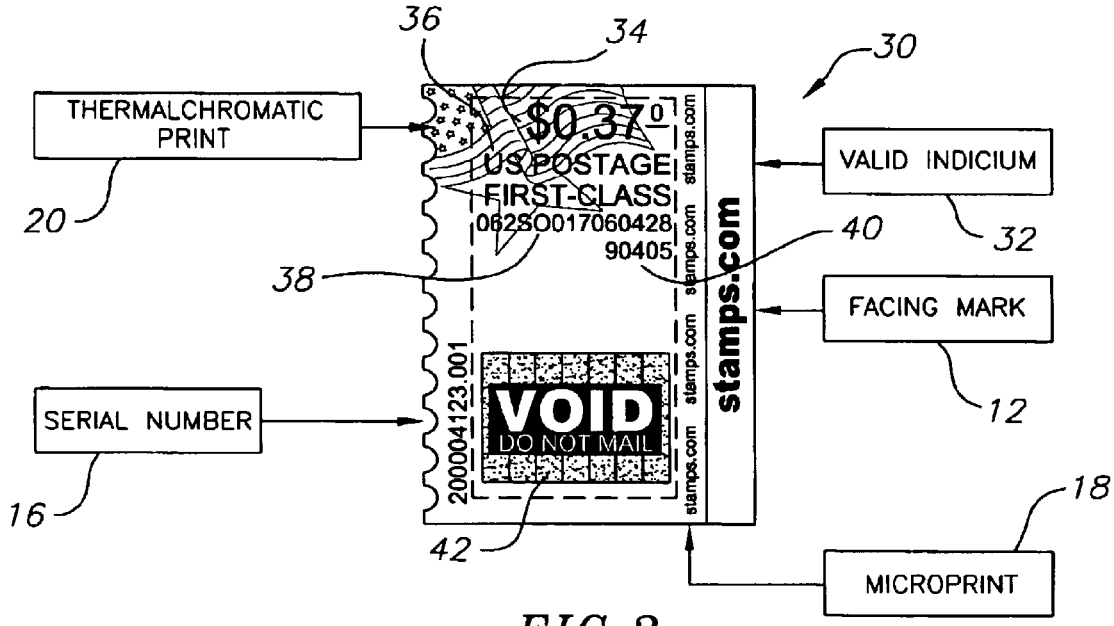
FIG. 2

SYSTEM AND LAYOUT FOR PROPER PRINTING OF NETSTAMPS AND OTHER LABELS

BACKGROUND OF THE INVENTION

The invention relates to the field of systems and layouts for printing indicia on labels, and more particularly to a system for guiding a user as to the proper way to feed sheets of labels without indicia into a printer, so that the indicia can be properly printed on the sheets of labels regardless of the printer used, and a label layout for use with the system.

Providers of internet postage systems have long experienced occasional problems with misprinted postage. Some of these misprints are caused by a user feeding a sheet of blank labels into a printer in an incorrect orientation. Stamps.com has recently introduced its NetStamps™ labels and system, which are specialized sheets of labels and software for use therewith, whose labels are designed to be printed with postage indicia but not a date code or a mailing address code. Stamps.com's NetStamps™ labels can be printed with postage indicia one at a time (e.g. a $0.37 first class stamp), or an entire sheet can be printed with the same postage value. Since the process of printing an entire sheet of labels with indicia carries the risk of printing an entire sheet of labels incorrectly and thus creating invalid postage, it is important that these label sheets be fed into the printer in the proper orientation. Computer printers often vary from manufacturer to manufacturer and model to model as to how label sheets must be fed in for properly oriented printing. Users can sometimes become confused and make errors and forget how to feed blank label sheets into printers, and accordingly, frequently make errors and print invalid postage labels.

The U.S. Postal Service ("USPS") maintains very strict requirements that PC postage users must adhere to with respect to processing and refunding misprinted postage. Currently, physical proof of misprints is required for money to be reimbursed by the USPS. When a user misprints and seeks to obtain a refund, the process is both time consuming and troublesome. A user must often wait several weeks for a misprint reimbursement request to be processed, and during this time they will not have replacement funds in their PC mail meter. Misprints can therefore be more costly up front for a user if they must put additional postage into their meter before obtaining a refund. While printing one label on a sheet with the indicia incorrectly oriented may not be a problem for a user, misprinting one or several sheets of label with invalid indicia can become burdensome and costly.

It is accordingly desirable to have provided a system for helping guide a user as to the proper way to feed sheets of labels without indicia into a printer, so that the indicia can be properly printed onto the sheets of labels regardless of the printer used, and a label layout for use with the system.

SUMMARY OF THE INVENTION

The invention provides a system for guiding a user as to the proper way to feed sheets of labels without indicia into a printer, so that the indicia can be properly printed on the sheets of labels regardless of the printer used, and a label layout for use with the system.

In one embodiment, the invention provides a system for assisting a user with the proper feeding of sheets of labels into a printer so that the labels may be properly printed, comprising:

providing a sheet of labels with a target area located on the sheet of labels; and providing interactive computer software that guides a user to test a sheet feed orientation by feeding the sheet of labels into the printer, directs the printer to print an indication mark on the sheet of labels, and queries the user as to where the indication mark appears on the sheet of labels.

In another embodiment, the invention provides a system for assisting a user with the proper feeding of sheets of labels into a printer so that the labels may be properly printed with postage indicia, the system comprising:

providing a sheet bearing pre-printed labels for further printing with postage indicia, the sheet having a target marker located thereon; and providing interactive computer software that guides a user to feed a sheet of labels into the printer and directs the printer to print an indication mark on the sheet of labels.

In a further another embodiment, the invention provides a sheet bearing pre-printed labels for further printing with postage indicia, the sheet comprising an area where a plurality of self-stick labels are located, wherein each label is pre-printed with a preferably unique serial number, and a perimeter margin area having a target marker located thereon.

In a further embodiment, the invention provides a sheet bearing pre-printed labels for further printing with postage indicia, the sheet comprising:

an area where a plurality of self-stick labels are located, wherein each label is pre-printed with a preferably unique serial number; and another area that bears instructions on how to use the sheet, wherein a target area is further located on the sheet.

In yet a further embodiment, the invention provides a sheet of labels for printing with postage indicia, the sheet comprising:

an area where a plurality of labels are located; and an area bearing instructions on how to print labels.

BRIEF DESCRIPTION OF THE DRAWINGS

FIG. 1 is a top plan view of a single, exemplary NetStamps™ label preprinted with a facing mark, a unique serial number, microprinting, and a design element, but not yet printed with postage indicia.

FIG. 2 is a top plan view of the single, exemplary NetStamps™ label of FIG. 1, correctly printed with postage indicia (voided.)

DETAILED DESCRIPTION OF THE INVENTION

Figure 3:
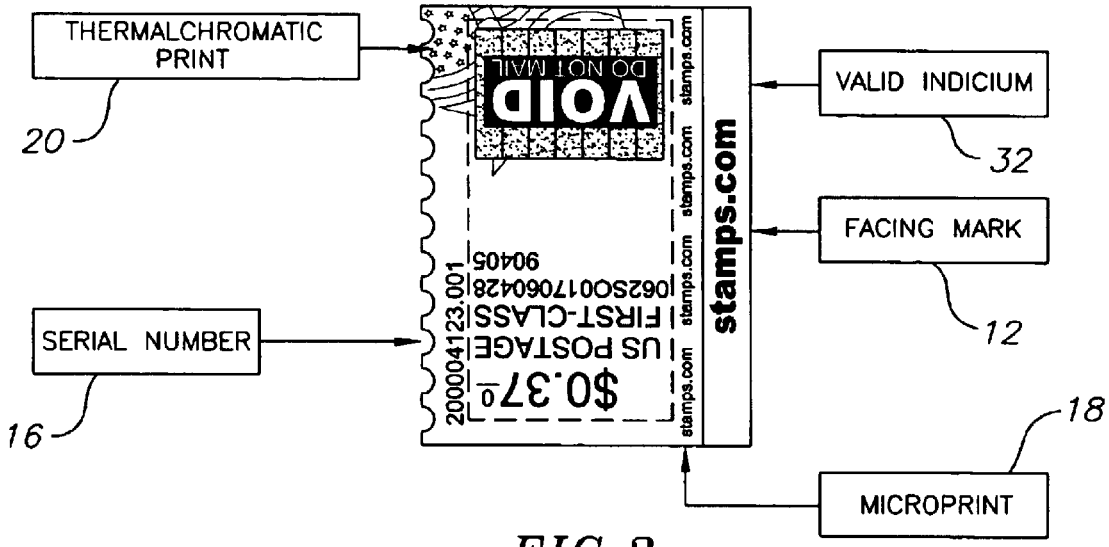
FIG. 3 is a top plan view of the single, exemplary NetStamps™ label of FIG. 1, improperly printed with postage indicia (voided).

The subject matter of U.S. patent application Ser. No. 09/975,532, filed Oct. 10, 2001 and entitled "SYSTEM AND METHOD FOR PROVIDING COMPUTER-BASED POSTAGE STAMPS" is incorporated by reference as if it appears in full herein.

FIG. 1 is a top plan view of a single, exemplary NetStamps™ label 10, not yet printed with postage indicia. Each individual NetStamps™ label 10 includes a facing mark 12 on an edge 14 of label, a preferably unique serial number 16, and microprinting 18. Additionally, graphical design element 20 can be preprinted onto label 10.

FIG. 2 is a top plan view of the single, exemplary NetStamps™ label 30 correctly printed with postage indicia 32 (but voided.) Postage indicia 32 comprises a dollar value indicator 34, a mail class indicator (e.g. "U.S. POSTAGE FIRST CLASS") 36, a user identification code 38 and user zip code 40, and a voided 2-D bar postage indicia code 42. The postage indicia 32 must be printed within a predetermined boundary area.

FIG. 3 is a top plan view of the single, exemplary NetStamps™ label of FIG. 1, improperly printed with postage indicia 32, mail class indicator (e.g. "U.S. POSTAGE FIRST CLASS") 36, dollar value indicator 34, user identification code 38 and user zip code 40, and a voided 2-D bar postage indicia code 42, all printed 180 degrees shifted from their correct placement on label.

Figure 4:
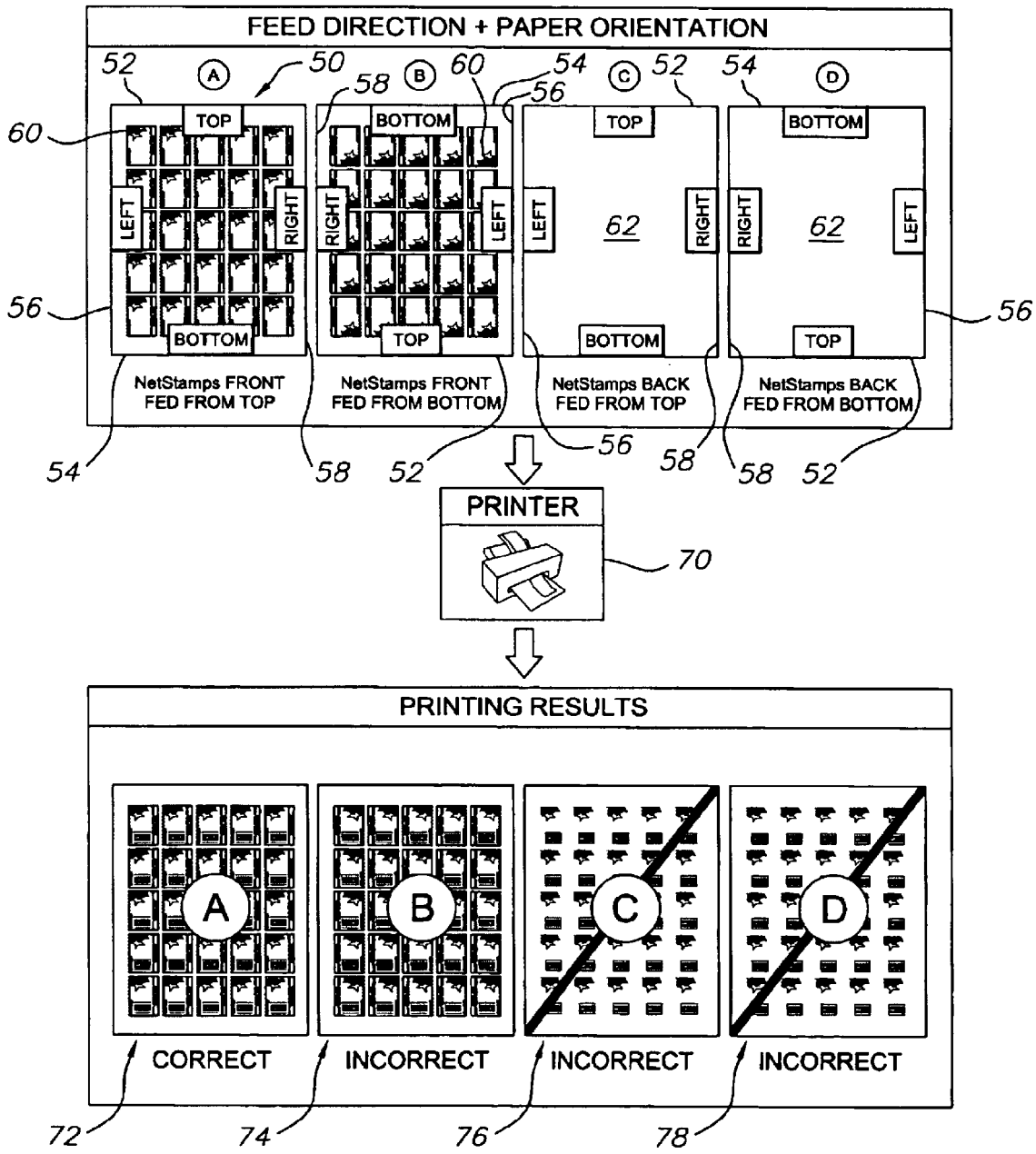
FIG. 4 is an exemplary schematic view showing four possible feed directions for a sheet of pre-printed labels through a printer, and the four possible print outcomes.
Figures 5A, 5B, 5C, 5D, 5E:
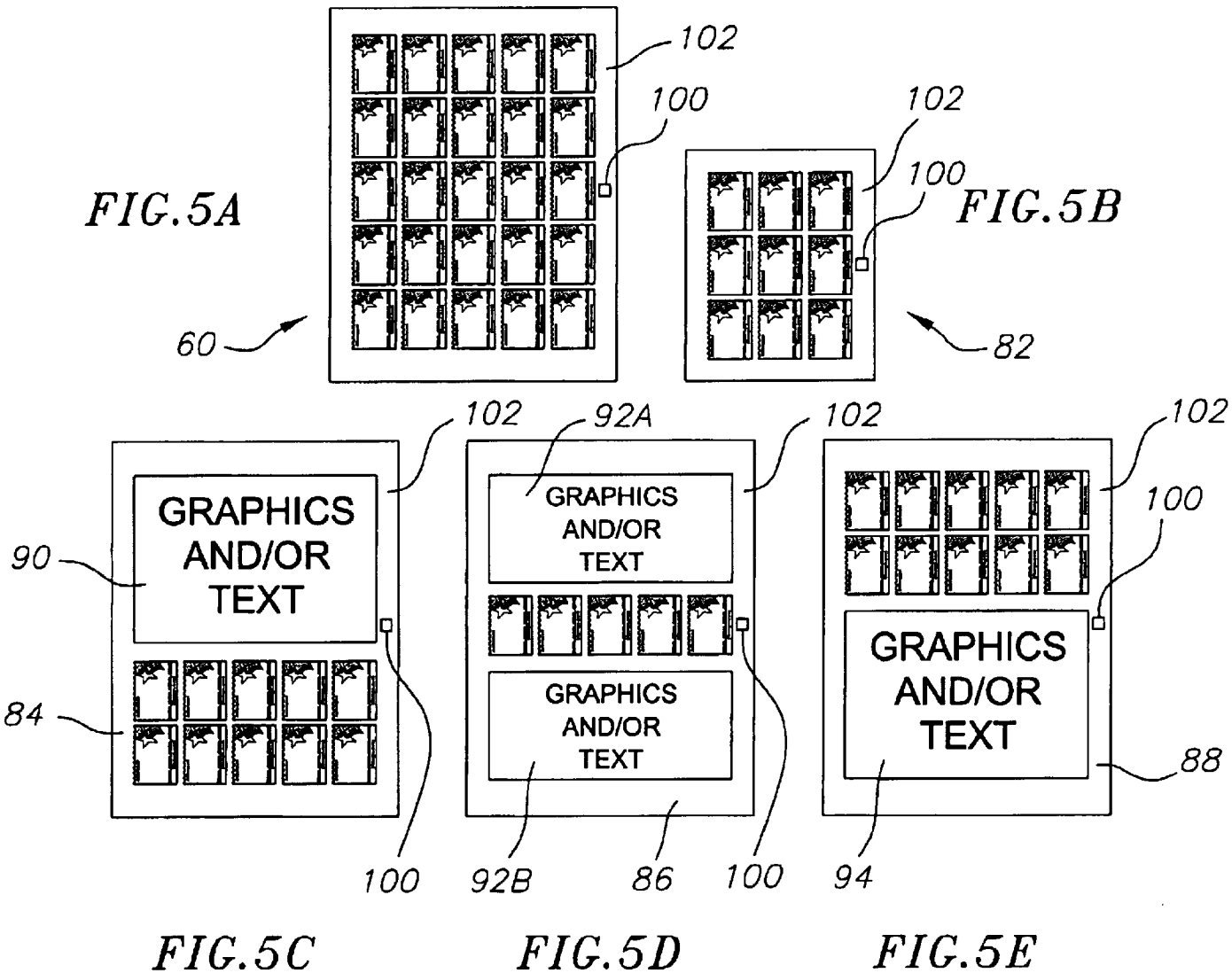
FIGS. 5A–5E shown five top plan views of five exemplary NetStamps™ label sheets.

FIG. 4 is an exemplary schematic view showing four possible feed directions for a sheet of labels 50 through a printer 70, and the four possible print outcomes 72, 74, 76 and 78. Each sheet of labels 50 has a top edge 52, and bottom edge 54, a left side edge 56, a right side edge 58, a top side 60 (printed with the facing mark, etc.) and a bottom side 62. Feed orientation A is where a sheet of labels 50 is front fed from the top, and results in correct printing of a sheet of stamps A. Feed orientation B is where a sheet of labels are front fed from the bottom, and results in an incorrect printing of a sheet of stamps B. Feed orientation C is where a sheet of labels are back fed from the top, and results in an incorrect printing of a sheet of stamps C. Lastly, feed orientation D is where a sheet of labels are back fed from the bottom, and results in an incorrect printing of a sheet of stamps D. Since there is only one our of four possible feed orientations, there is a risk that a user will inadvertently ruin a sheet of blank labels.

FIGS. 5A–5E shown five top plan views of five exemplary NetStamps™ label sheets 60, 82, 84, 86 and 88. Exemplary NetStamps™ label sheets 60 and 82 present full sheets of labels without large areas of graphics and/or text, and sheets 84, 86 and 88 present sheets of labels along with graphic and/or text areas 90, 92A and 92B and 94, respectively. Each label sheet 60, 82, 84, 86 and 88 has a target location 100 on a predetermined margin 102 of the label sheets, the purpose of which is explained below.

Figure 6:
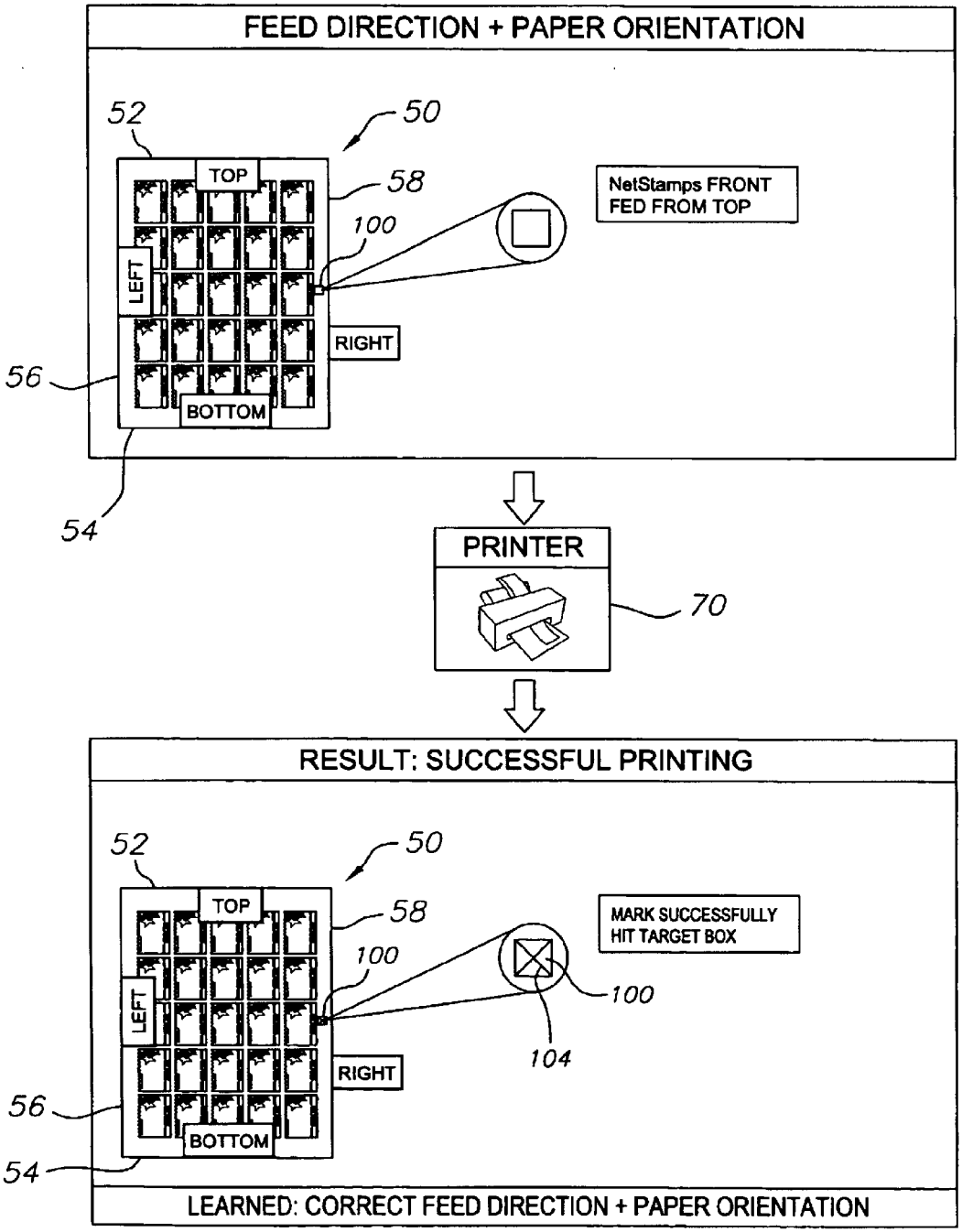
FIG. 6 is an exemplary schematic view showing a first, correct, feed direction and paper orientation for feeding a sheet of labels of the invention through a printer for test printing, and the correct test print outcome achieved.

FIG. 6 is an exemplary schematic view showing a first, correct, feed direction and paper orientation for feeding a blank sheet of labels 50 with a target location 100 of the invention feed through printer 70 for test printing. When label sheet 50 is fed through printer 70 in the correct orientation, the printer will print an indication mark 104 within the target location 100, thereby positively indicating to a user that the sheet of blank labels 50 has been fed into the printer in the proper orientation. Thereafter, the user can re-feed the sheet of labels 50 in that same orientation to achieve correct printing of postage indicia on the individual labels.

Figure 7:
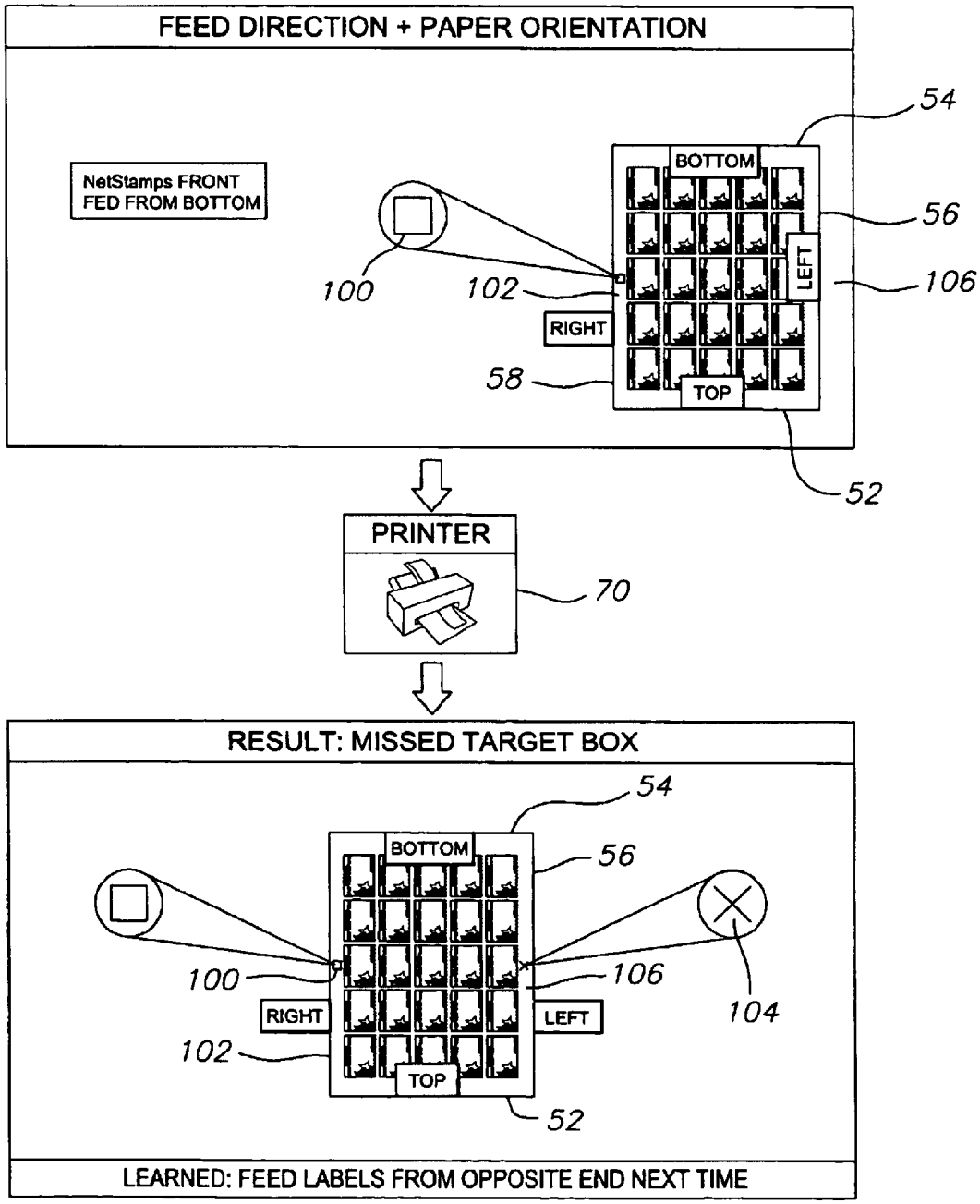
FIG. 7 is an exemplary schematic view showing a second, incorrect, feed direction and paper orientation for feeding a sheet of labels of the invention through a printer for test printing, and the incorrect test print outcome achieved.

FIG. 7 is an exemplary schematic view showing a second, incorrect feed direction and paper orientation for feeding a sheet of labels 50 of the invention through printer 70 for test printing, and the incorrect placement of the indication mark 104, not in target location 100, but instead on an opposite margin 106 of the sheet of labels 50. By the incorrect position of the indication mark 104, a user can thus quickly identify that the sheet 50 has been fed into the printer incorrectly from the wrong end, and the user can either turn the sheet by half a turn and re-feed it into printer 70 from the opposite end for re-testing, or optionally proceed directly to printing of the sheet of labels with postage with the knowledge that the sheet of labels must be fe into the printer in a corrected feed orientation.

Figure 8:
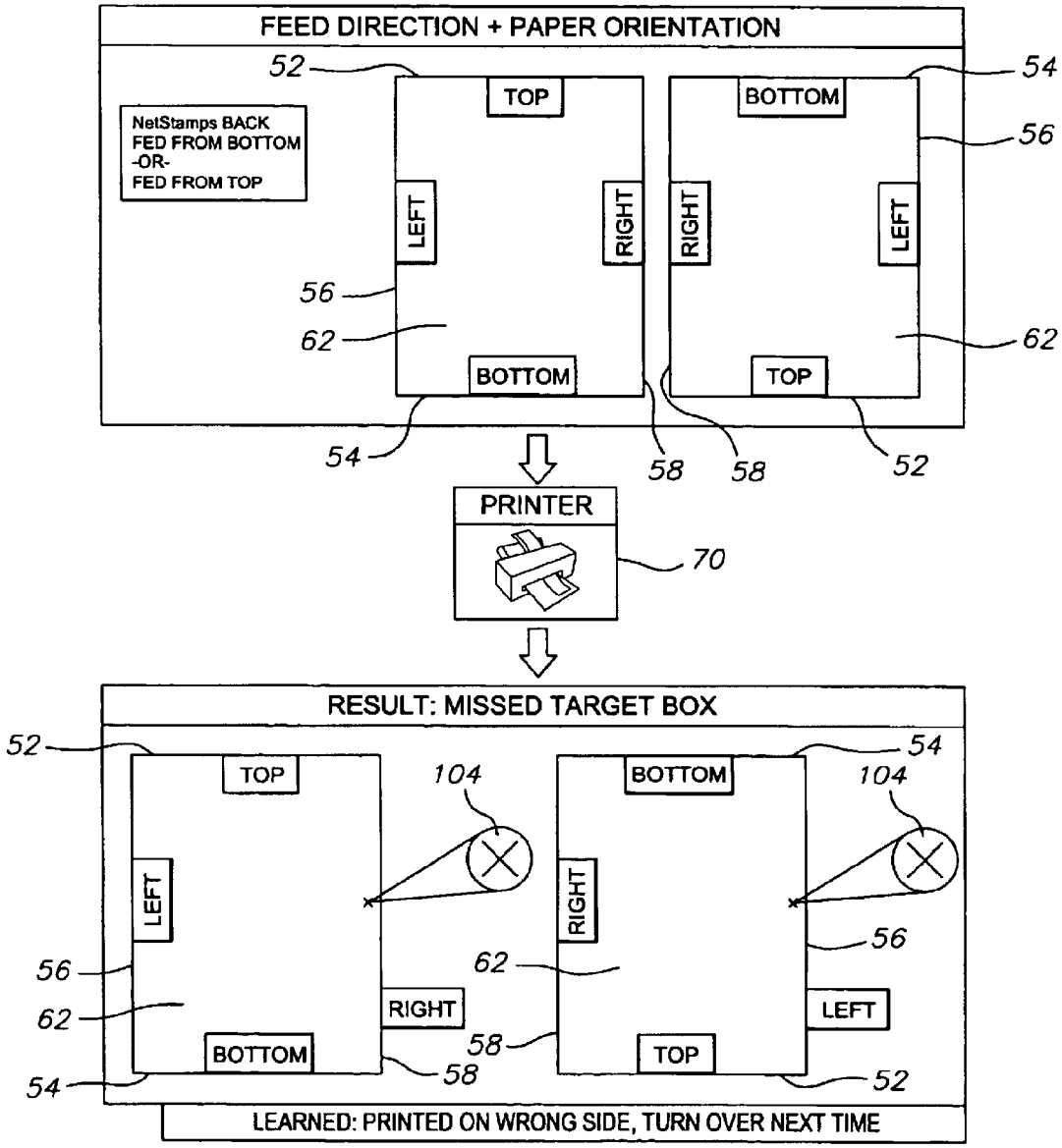
FIG. 8 is an exemplary schematic view showing a third and fourth, incorrect, feed directions and paper orientations for feeding a sheet of labels of the invention through a printer for test printing, and the incorrect test print outcome achieved.

FIG. 8 is an exemplary schematic view showing a third (sheet on left side) and fourth (sheet on right side), incorrect, feed directions and paper orientations for feeding a sheet of labels 50 of the invention through a printer 70 for test printing, and the incorrect placement of the indication mark 104 not in target location 100, but instead on back sides 62 of the sheet of labels. Either incorrect placement of indication mark 104 will act to indicate to the user that the wrong side of the label sheets is being printed, and that the user must turn the sheet over for re-testing. In practice, if the indicator mark 104 is on the obverse side of the sheet directly behind the target location 100, then the user will need to flip the sheet of labels over. If the indicator mark 104 is on the obverse side of the sheet but on an opposite side of the sheet than the target location 100, then the user will need to flip the sheet of labels over and turn it by 180 degrees to achieve the correct feed orientation.

Figure 9:
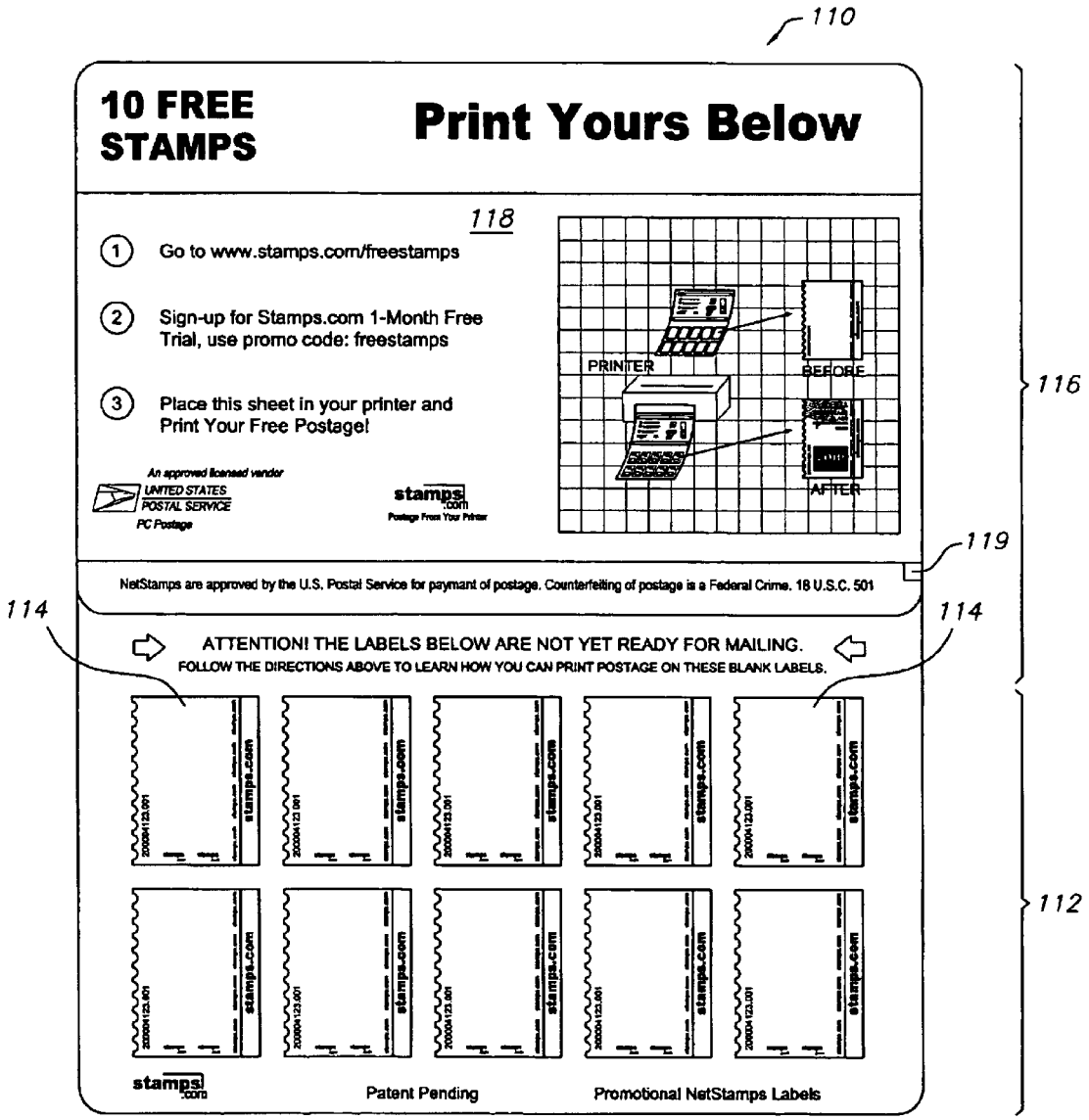
FIG. 9 is an embodiment of an exemplary sheet of labels of the invention having an area where a plurality of labels is located and an area bearing instructions on how to print labels.

FIG. 9 is an exemplary sheet of labels 110 of the invention having an area 112 where a plurality of labels 114 is located and an area 116 on the sheet that bears instructions 118 on how to print labels and other subject matter if desired. The instructions can include text, pictures, and if desired, any other indicia. Optionally, a target area 119 can also be located on the sheet to help a user confirm that the feed orientation into the printer is correct before the user attempts to print postage indicia onto the label(s).

Figure 10:
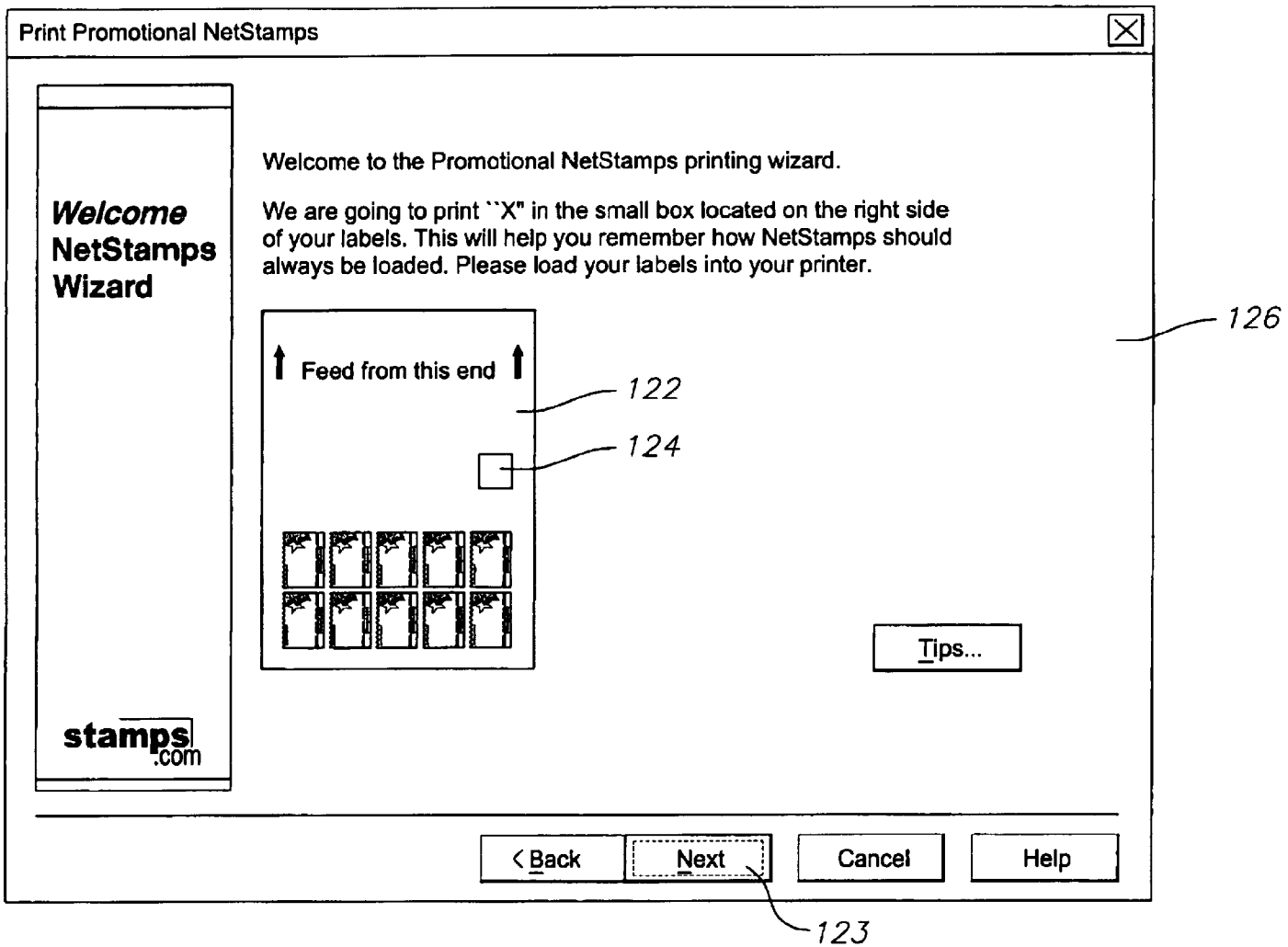
FIG. 10 is an exemplary opening screen print showing an exemplary software program for guiding a user through a wizard for properly orienting a sheet of labels in a printer for printing with PC postage.

FIG. 10 is an exemplary opening screen print 120 showing an exemplary software program "wizard" for guiding a user through a process for properly orienting a sheet of labels in a printer for printing with PC postage. The screen print 120 will display a view of a sheet of labels 122 along with its target location 124 along with instructions 126 for printing a test page using a sheet of labels. By selecting a "Next" command 128, the software wizard will advance to a print page, an example of which is shown in FIG. 10.

Figure 11:
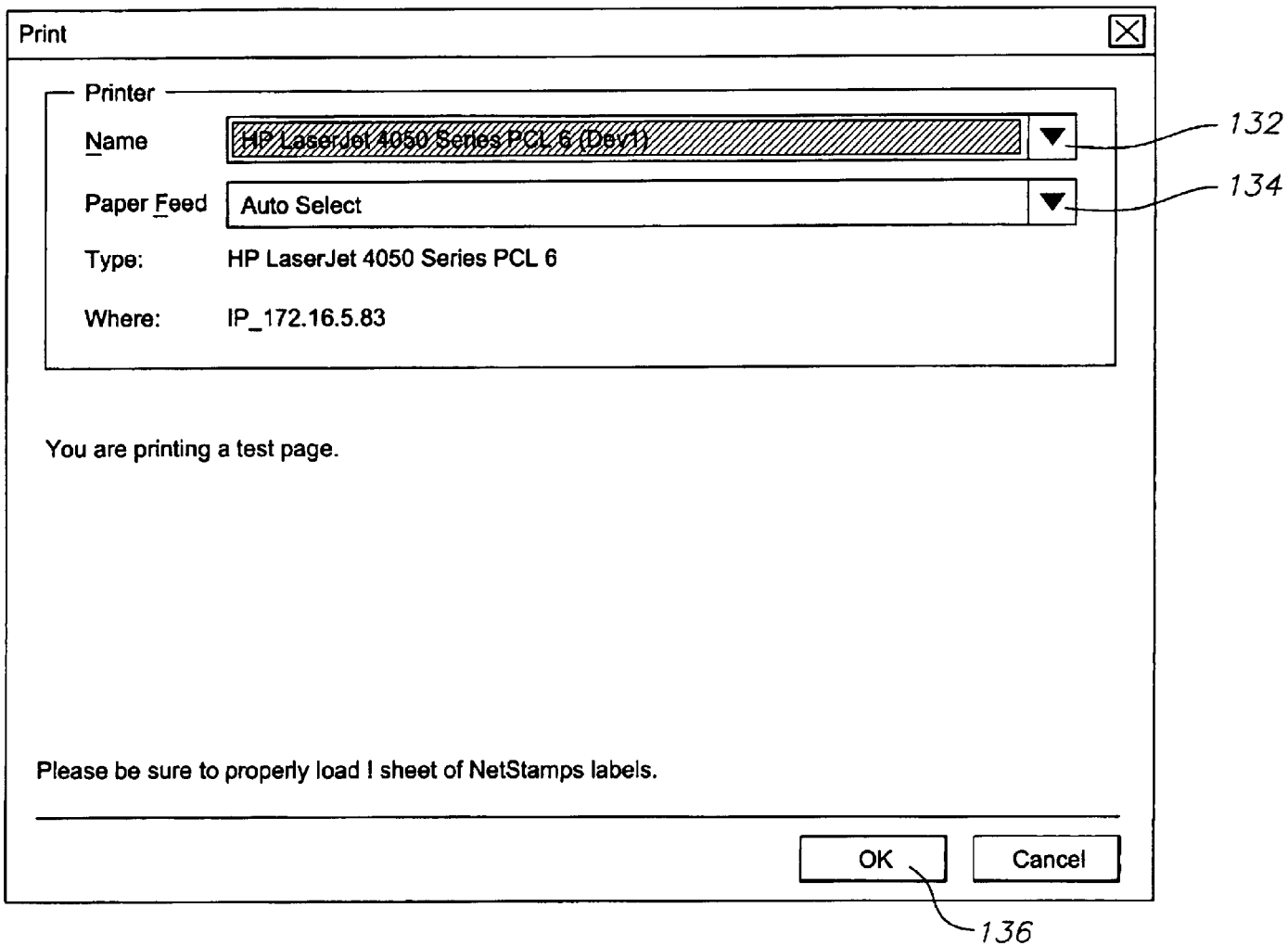
FIG. 11 is an exemplary screen print showing an exemplary "print" function with a printer selected and the paper feed selected.

FIG. 11 is an exemplary screen print 130 showing an exemplary "print" function with a printer selected 132 and a paper feed mode 134 selected. By selecting an "OK" command 136, a test page of the sheet of labels will be printed.

Figure 12:
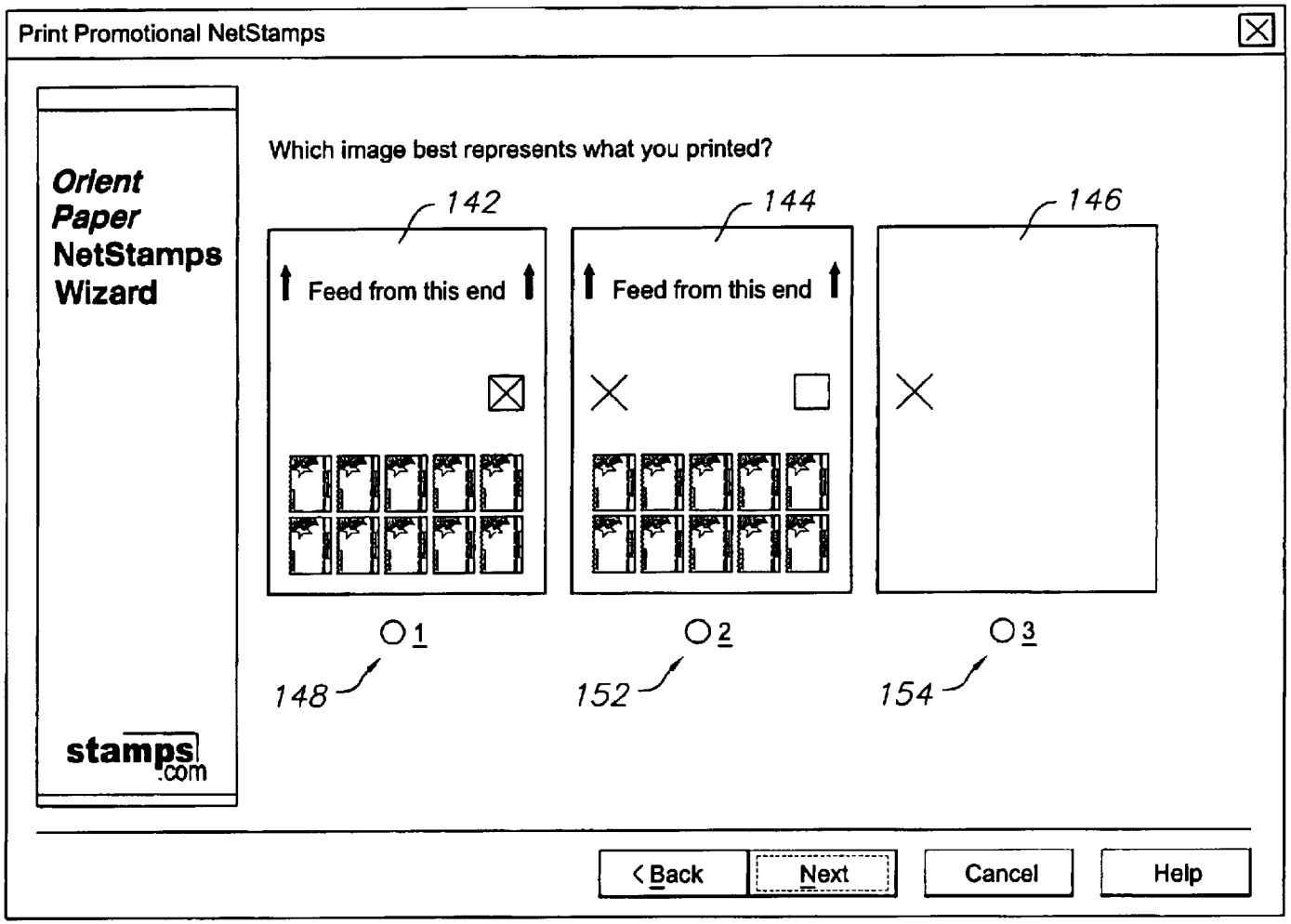
FIG. 12 is an exemplary screen print of the exemplary software program confirming whether the sheet of labels was properly oriented and fed into the selected printer.

FIG. 12 is an exemplary screen print 140 of the exemplary software program confirming whether the sheet of labels was properly oriented and fed into the selected printer (which corresponds to orientation 142) or an incorrect orientation, as shown in the representations of 144 or 146. If a user selects button 142 (where indication mark 104 is in target location 100—indicating the correct feed orientation of the sheet of labels through the printer), by selecting its corresponding select button 148, then the wizard will advance to another screen (not shown) that can inform the user to proceed with printing of the labels with postage. If a user selects buttons 152 or 154, corresponding to images 144 and 146, respectively, then the software wizard will instruct the user to change how the sheet of labels is loaded into the printer, and to retry printing, and can loop back to the print screen 120 shown in FIG. 9 and proceed on.

Although the target area 100 is shown as a small box with a border, and the indication mark 104 is shown as a "X" mark, the size, shape, and general placement of the target area 100 and of the indication mark 104 can be selected from any number of sizes, shapes and placements. However, the target area 100 and indication mark 104 should not appear on any areas of the sheet of labels that bear a label so as not to ruin any individual labels on the sheet of labels. A margin area, as shown, can be ideal, although others areas of the sheet of labels could be selected as well. Moreover, while particular, exemplary sheets of labels (e.g. FIGS. 5A–E are shown) other styles and layouts of labels on sheets can be used, as well as the appearance of labels can use used.

Having thus described exemplary embodiments of the present invention, it should be understood by those skilled in the art that the above disclosures are exemplary only and that various other alternatives, adaptations and modifications may be made within the scope of the present invention. The presently disclosed embodiments are to be considered in all respects as illustrative and not restrictive.

What is claimed is:

1. A sheet bearing pre-printed labels for further printing with postage indicia, the sheet comprising an area where a plurality of self-stick labels are located, wherein each label is pre-printed with a serial number, and a perimeter margin area having a target marker located thereon, which target marker will be printed with an indication mark only when the sheet has been fed into a printer in a proper orientation.

2. The sheet bearing pre-printed labels of claim 1, wherein each label is further pre-printed with a facing mark and microprinting.

3. A sheet bearing pre-printed labels for further printing with postage indicia, the sheet comprising:

an area where a plurality of self-stick labels are located, wherein each label is pre-printed with a unique serial number; and another area that bears instructions on how to use the sheet, wherein a target area is further located on the sheet, which target area will be printed with an indication mark only when the sheet has been fed into a printer in a proper orientation.

4. The sheet of claim 3, wherein the target area is located on a perimeter margin area of the sheet.

5. A sheet of labels for printing with postage indicia, the sheet comprising:

an area where a plurality of labels are located;

an area bearing instructions on how to print labels; and a target area for the printer to print an indication mark, which target area will be printed with an indication mark only when the sheet has been fed into a printer in a proper orientation.

6. The sheet of labels of claim 5, wherein the target area is located on a perimeter margin area of the sheet.

7. The sheet of labels of claim 5, wherein the target area is located on the area bearing instructions.

* * * * *